US010018412B2

(12) United States Patent
Sarigiannis et al.

(10) Patent No.: US 10,018,412 B2
(45) **Date of Patent: *Jul. 10, 2018**

(54) METHOD AND SYSTEM FOR PROVIDING SUPPLEMENTAL REFRIGERATION TO AN AIR SEPARATION PLANT

(71) Applicants: Catherine B. Sarigiannis, Grand Island, NY (US); Anna Knight, Getzville, NY (US); Evelyn Juandi, Ontario (CA); Wei Zhang, Ontario (CA); Jeremiah J. Rauch, Clarence, NY (US)

(72) Inventors: Catherine B. Sarigiannis, Grand Island, NY (US); Anna Knight, Getzville, NY (US); Evelyn Juandi, Ontario (CA); Wei Zhang, Ontario (CA); Jeremiah J. Rauch, Clarence, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 282 days.

This patent is subject to a terminal disclaimer.

(21) Appl. No.: 14/935,680

(22) Filed: Nov. 9, 2015

(65) Prior Publication Data

US 2017/0131029 A1 May 11, 2017

(51) Int. Cl.
*F25J 3/04* (2006.01)

(52) U.S. Cl.
CPC ..... *F25J 3/04412* (2013.01); *F25J 3/0409* (2013.01); *F25J 3/04175* (2013.01); *F25J 3/04224* (2013.01); *F25J 3/04278* (2013.01); *F25J 3/04296* (2013.01); *F25J 3/04812* (2013.01); *F25J 2210/06* (2013.01); (Continued)

(58) Field of Classification Search
CPC .... F25J 3/04187; F25J 3/04412; F25J 3/0409; F25J 3/04812; F25J 3/04175; F25J 3/04278; F25J 2210/06; F25J 2270/14
See application file for complete search history.

(56) References Cited

U.S. PATENT DOCUMENTS

| | | | |
|---|---|---|---|
| 4,372,764 | A | 2/1983 | Theobald |
| 6,779,361 | B1 | 8/2004 | Skare et al. |
| 8,397,535 | B2 | 3/2013 | Howard et al. |

(Continued)

*Primary Examiner* — Brian King
(74) *Attorney, Agent, or Firm* — Robert J. Hampsch

(57) ABSTRACT

A system and method for providing supplemental refrigeration to an air separation plant is provided. A closed loop supplemental refrigeration circuit that can be easily retrofitted or added onto an air separation plant that increases the liquid product production capability of the air separation plant. The supplemental refrigeration capacity of the supplemental refrigeration circuit is controlled by removing or adding a portion of the refrigerant in the supplemental refrigeration circuit to adjust the inlet pressure while maintaining a substantially constant volumetric flow rate and substantially constant pressure ratio across the compressor. Removing the refrigerant from the supplemental refrigeration circuit decreases the refrigeration imparted by the supplemental refrigeration circuit and thus provides the capacity to turn-down liquid product make without shutting down the compressors and turbo-expanders in the supplemental refrigeration circuit.

16 Claims, 1 Drawing Sheet

(52) U.S. Cl.
CPC ..... *F25J 2270/14* (2013.01); *F25J 2270/40* (2013.01); *F25J 2270/902* (2013.01)

(56) References Cited

U.S. PATENT DOCUMENTS

| | | | | |
|---|---|---|---|---|
| 9,291,388 | B2 * | 3/2016 | Rauch | F25J 3/04812 |
| 2010/0287986 | A1 * | 11/2010 | Jibb | F25J 3/0409 62/640 |
| 2010/0313600 | A1 | 12/2010 | Howard et al. | |
| 2013/0192301 | A1 * | 8/2013 | Rauch | F25J 3/04812 62/652 |

* cited by examiner

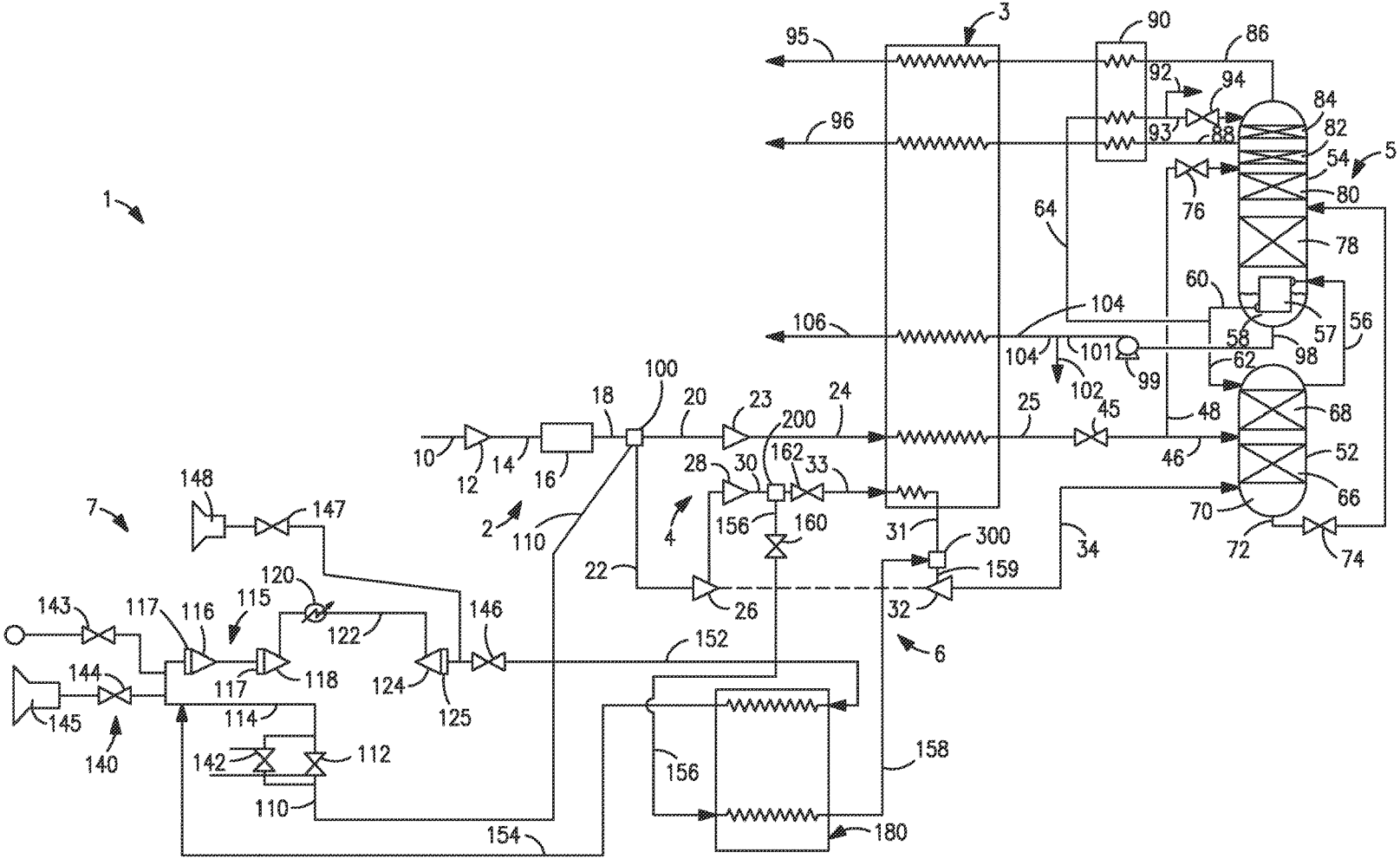

METHOD AND SYSTEM FOR PROVIDING SUPPLEMENTAL REFRIGERATION TO AN AIR SEPARATION PLANT

FIELD OF THE INVENTION

The present invention relates to a method and system for cryogenic air separation involving production of liquid products by using a closed loop supplemental refrigeration circuit. More particularly, the present invention relates to a supplemental refrigeration circuit that can be easily tied-in to an existing air separation plant.

BACKGROUND

Oxygen is separated from oxygen containing feeds, such as air, through cryogenic rectification. In order to operate a cryogenic rectification plant, refrigeration must be supplied to offset ambient heat leakage, warm end heat exchange losses and to allow the extraction or production of liquid products, including liquid oxygen, liquid nitrogen, or liquid argon. While the main source of refrigeration for a cryogenic rectification plant is typically supplied by expanding part of the feed air stream or a waste stream to generate a cold stream that is then introduced into the main heat exchanger or the distillation column, external refrigeration can also be imparted by other refrigerant streams introduced into the main heat exchanger, including a refrigerant stream from a closed loop supplemental refrigeration cycles as described in U.S. Pat. No. 8,397,535.

One of the limitations or drawbacks of the existing closed loop refrigeration cycles used in air separation plants is that the centrifugal compressors and turbo-expanders in such supplemental refrigeration circuits involve additional capital costs that when operating, are generally operating in an 'on' or 'off' mode. In other words, the centrifugal compressors and turbo-expanders are either operating so as produce the supplemental refrigeration and additional liquid product make or are shut down thereby not producing supplemental refrigeration or foregoing any additional liquid product make. The continued cycling of the centrifugal compressors and turbo-expanders between operating mode and shut-down mode adversely impacts the overall efficiency and reliability of the supplemental refrigeration cycle.

A small degree of adjustment in existing supplemental refrigeration circuits may be achieved through the adjustment of compressor inlet guide vanes. However, one must be careful of adjustments that would sent the compressor into a surge condition or a stonewall conditions as a result of too little or too much flow to the compressor. As a result, the existing or prior art supplemental refrigeration circuits are generally operated at a fixed or near-fixed operating point. This inability to modulate the level of supplemental refrigeration over broad operating ranges effectively limits the plant operator from precisely controlling the amount of liquid product produced by the air separation plant at any given time.

Another challenge to the use of closed loop refrigeration circuits is encountered when integrating such closed loop refrigeration circuits into the design of a cryogenic air separation plant and associated air separation cycle. Such integration typically requires changes to one or more of the main air compression train, the main heat exchanger, the distillation columns, and/or the turbine expansion based refrigeration circuits of the air separation plant. In addition, for some cryogenic air separation plants there is a need to design the refrigeration and liquefaction process that avoids or defers some of the up-front capital costs associated with the closed loop refrigeration cycles but allows such supplemental refrigeration to be easily added to the cryogenic air separation plant at a later date after construction of the air separation plant when the liquid product requirements change.

What is needed, therefore, is a closed loop refrigeration circuit that can be easily retrofitted to an air separation plant at a later date to address the upfront capital cost and design challenges associated with closed loop refrigeration circuits. Once installed, the add-on closed loop refrigeration circuit should be capable of modulating the level of supplemental refrigeration produced over broad operating ranges and thus allows more precise control of the amount of liquid product produced by the air separation plant.

SUMMARY OF THE INVENTION

In a broad sense, the present invention is a system and method for providing supplemental refrigeration to an air separation plant by means of a closed loop supplemental refrigeration circuit that can be easily retrofitted or added to an air separation plant at a later date to increase the liquid product production capability of the air separation plant. The supplemental refrigeration capacity of the supplemental refrigeration circuit is controlled by removing or adding a portion of the refrigerant in the supplemental refrigeration circuit to adjust the inlet pressure while maintaining a substantially constant volumetric flow rate and substantially constant pressure ratio across the compressor. Removing the refrigerant from the supplemental refrigeration circuit decreases the refrigeration imparted by the supplemental refrigeration circuit and thus provides the capacity to turn-down liquid product make without shutting down the compressors and turbo-expanders in the supplemental refrigeration circuit.

Specifically, the present invention may be characterized as a method of separating air comprising the steps of: (i) conducting a cryogenic rectification process in an air separation plant comprising a main heat exchanger to cool a compressed and purified feed air stream to a temperature suitable for the rectification of the feed air stream and a distillation column system configured to rectify the compressed, purified and cooled air to produce at least one liquid product stream; (ii) diverting a portion of the compressed and purified feed air stream as a working fluid to a supplemental refrigeration circuit; (iii) compressing the working fluid in a compressor section within the supplemental refrigeration circuit; (iv) expanding the working fluid in a turbo-expander disposed within the supplemental refrigeration circuit to produce a cooled working fluid; (v) directing the cooled working fluid to an auxiliary heat exchanger and warming the cooled working fluid in the auxiliary heat exchanger via indirect heat exchange with a boosted compressed air stream from the air separation plant; (vi) recirculating the warmed working fluid to the compressor section within the supplemental refrigeration circuit after having passed through auxiliary heat exchanger; and (vii) returning the cooled, boosted compressed air stream exiting the auxiliary heat exchanger to the air separation plant to impart a portion of the refrigeration required by the air separation plant.

The present invention may also be characterized as method of providing supplemental refrigeration to an air separation plant comprising the steps of: (i) diverting a portion of a compressed and purified feed air stream from the air separation plant as a working fluid to a supplemental refrigeration circuit; (ii) compressing the working fluid in a compressor section within the supplemental refrigeration circuit; (iii) expanding the working fluid in a turbo-expander disposed within the supplemental refrigeration circuit to produce a cooled working fluid; (iv) directing the cooled working fluid to an auxiliary heat exchanger and warming the cooled working fluid in the auxiliary heat exchanger via indirect heat exchange with a boosted compressed air stream diverted from the air separation plant; (v) recirculating the warmed working fluid to the compressor section within the supplemental refrigeration circuit after having passed through the auxiliary heat exchanger; and (vi) returning the cooled, boosted compressed air stream exiting the auxiliary heat exchanger to the air separation plant to impart a portion of the refrigeration required by the air separation plant.

Alternatively, the present invention may be characterized as a supplemental refrigeration system comprising: (a) an intake conduit configured to be coupled to an air separation plant and receive a portion of a compressed and purified air stream from the air separation plant, wherein the portion of the compressed and purified air stream forms a working fluid; (b) a compressor section fluidically coupled to the intake conduit and configured to compress the working fluid; (c) a turbo-expander section operatively coupled to the compressor section and configured to expand the compressed working fluid to generate a cooled working fluid; (d) an auxiliary heat exchanger configured to be coupled to the air separation plant to receive a boosted compressed air stream from the air separation plant and return a cooled, boosted compressed air stream back to the air separation plant; (e) the auxiliary heat exchanger further configured to receive the cooled working fluid from the turbo-expander section and warm the cooled working fluid via indirect heat exchange with the boosted compressed air stream from the air separation plant to impart a portion of the refrigeration required by the air separation plant; and (f) a recirculating conduit configured to return the warmed working fluid from the auxiliary heat exchanger to the compressor section.

Finally, the invention may also be characterized as an air separation plant configured to produce at least one liquid product stream, the air separation plant comprising: (a) an air intake circuit configured to compress and purify an incoming feed air stream; (b) a distillation column system configured to rectifying the compressed and purified feed air stream by a cryogenic rectification process to produce at least one liquid product stream; (c) a main heat exchanger operatively associated with the compressed and purified feed stream and distillation column system and configured to cool the compressed and purified feed stream to a temperature suitable for the rectification of the compressed and purified feed air stream; (d) a supplemental refrigeration circuit coupled to the main heat exchanger, the supplemental refrigeration circuit comprising: (d1) an intake conduit configured to receive a portion of a compressed and purified feed air stream from the air intake circuit wherein the portion of the compressed and purified feed air stream forms a working fluid; (d2) a compressor section fluidically coupled to the intake conduit and configured to compress the working fluid; (d3) a turbo-expander section operatively coupled to the compressor section and configured to expand the compressed working fluid to generate a cooled working fluid; (d4) an auxiliary heat exchanger configured to receive the cooled working fluid from the turbo-expander section and warm the cooled working fluid via indirect heat exchange with a boosted compressed air stream from the air separation plant to impart a portion of the refrigeration required by the air separation plant; and (d5) a recirculating conduit configured to return the warmed working fluid from the auxiliary heat exchanger to the compressor section.

BRIEF DESCRIPTION OF THE DRAWING

While the present invention concludes with claims distinctly pointing out the subject matter that Applicants regard as their invention, it is believed that the invention will be better understood when taken in connection with the accompanying drawing (FIG. 1) which is a schematic process flow diagram of a cryogenic air separation plant integrated with an add-on supplemental refrigeration circuit in accordance with the present invention.

DETAILED DESCRIPTION

Turning now to FIG. 1, there is shown a simplified illustration of a cryogenic air separation plant 1. In a broad sense, the cryogenic air separation plant 1 includes a main feed air compression train 2, a main or primary heat exchanger 3, a turbine based refrigeration circuit 4, and a distillation column system 5. Most cryogenic air separation plants may further include various booster air compression circuits 6 and optionally a closed loop supplemental refrigeration circuit 7. The cryogenic air separation plant 1 depicted in FIG. 1 includes an add-on supplemental refrigeration circuit 7 which is integrated with and designed to allow increase production of liquid products from the air separation plant 1 and allow turn-down of liquid product make when less liquid products are required in a manner that optimizes the overall air separation plant efficiency and costs.

In the main feed compression train 2 shown in FIG. 1, the incoming feed air 10 is compressed in a multi-stage, intercooled main air compressor arrangement 12 to a pressure that can be between about 5 bar(a) and about 15 bar(a). This main air compressor arrangement 12 may be an integrally geared compressor or a direct drive compressor. The compressed air feed 14 is then purified in a pre-purification unit 16 to remove high boiling contaminants from the incoming feed air. A pre-purification unit 16, as is well known in the art, typically contains beds of alumina and/or molecular sieve operating in accordance with a temperature and/or pressure swing adsorption cycle in which moisture and other impurities, such as carbon dioxide, water vapor and hydrocarbons, are adsorbed.

As described in more detail below, the compressed, purified feed air stream 18 is separated into oxygen-rich, nitrogen-rich, and argon-rich fractions in a plurality of distillation columns including a higher pressure column 52, a lower pressure column 54, and optionally, argon column (not shown). Prior to such distillation however, the compressed, pre-purified feed air stream 18 is split into a plurality of feed air streams, including streams 20, 22 that are cooled to temperatures suitable for rectification. Cooling the compressed, purified feed air streams is accomplished by way of indirect heat exchange in main heat exchanger 3 with the warming streams which include the oxygen, nitrogen and/or argon streams from the distillation column system 5. Refrigeration is also typically generated by the cold and/or warm turbine arrangements disposed within the turbine based refrigeration circuits 4 and any optional closed loop warm refrigeration circuit 7.

In the illustrated embodiment, the compressed and purified feed air stream 18 is divided into a first stream 20, a second stream 22 and a third stream 110. First stream 20 is then further compressed within a booster compressor arrangement 23, of the booster air compression circuit 6, which preferably comprises another single or multi-stage intercooled compressor. As with the main air compressor arrangement 12, this second compressor arrangement 23 may be an integrally geared compressor or a direct drive compressor. This second compressor arrangement 23 further compresses the first stream 20 to a pressure between about 25 bar(a) and about 70 bar(a) to produce a further compressed stream 24. The further compressed stream 24 is directed or introduced into main heat exchanger 3 where it is cooled and liquefied at the cold end of main heat exchanger 3 to produce a first liquid air stream 25. The liquid air stream 25 is then partially expanded in an expansion valve 45 and divided into liquid streams 46 and 48 for introduction into the distillation column system 5.

As illustrated, second stream 22 is directed to a turbine based refrigeration circuit 4. Turbine based refrigeration circuits are often referred to as either a lower column turbine (LCT) arrangement or an upper column turbine (UCT) arrangement which are used to provide refrigeration to a two-column or three column cryogenic air distillation column system. In the LCT arrangement shown in FIG. 1, a portion of the pre-purified, compressed feed air 18 is further compressed and partially cooled in the main or primary heat exchanger 3. Specifically, stream 22 is further compressed by a turbine loaded booster compressor 26 and yet further compressed by a second booster compressor 28 to a pressure that can be in the range from between about 20 bar(a) to about 60 bar(a) to produce further compressed stream 30. Further compressed stream 30 is also directed or introduced into main heat exchanger 3 in which it is partially cooled to a temperature in a range of between about 160 and about 220 Kelvin to form a partially cooled stream 31 that is subsequently introduced into a turbo-expander 32 to produce an exhaust stream 34 that is introduced into the higher pressure column 52 of distillation column system 5. Turbo-expander 32 is preferably linked with booster compressor 26, either directly or by appropriate gearing.

While the turbine air circuit illustrated in FIG. 1 is shown as a lower column turbine (LCT) air circuit where the expanded exhaust stream is fed to the higher pressure column of the distillation column system, it is contemplated that the turbine based refrigeration circuit alternatively may be an upper column turbine (UCT) air circuit where the turbine exhaust stream is directed to the lower pressure column. Still further, the turbine air circuit may be combinations of LCT circuits and UCT circuits and/or even other variations of such known turbine air circuits such as a partial lower column turbine (PLCT).

All or a portion of this further compressed, partially cooled stream is diverted to a turbo-expander, which may be operatively coupled to and drive a compressor. The expanded gas stream or exhaust stream is then directed to the higher pressure column of a two-column or three column cryogenic air distillation column system. The supplemental refrigeration created by the expansion of the diverted stream is thus imparted directly to the higher pressure column thereby alleviating some of the cooling duty of the primary heat exchanger.

Similarly, in an alternate embodiment that employs a UCT arrangement (not shown), a portion of the purified and compressed feed air may be partially cooled in the primary heat exchanger, and then all or a portion of this partially cooled stream is diverted to a warm turbo-expander. The expanded gas stream or exhaust stream from the warm turbo-expander is then directed to the lower pressure column in the two-column or three column cryogenic air distillation column system. The cooling or supplemental refrigeration created by the expansion of the exhaust stream is thus imparted directly to the lower pressure column thereby alleviating some of the cooling duty of the main heat exchanger.

The aforementioned components of the feed air streams, namely oxygen, nitrogen, and argon are separated within the distillation column system 5 that consists of a higher pressure column 52 and a lower pressure column 54. It is understood that if argon were a necessary product, an argon column (not shown) could be incorporated into the distillation column system 5. The higher pressure column 52 typically operates in the range from between about 20 bar(a) to about 60 bar(a) whereas the lower pressure column 54 typically operates at pressures between about 1.1 bar(a) to about 1.5 bar(a).

The higher pressure column 52 and the lower pressure column 54 are linked in a heat transfer relationship such that a nitrogen-rich vapor column overhead, extracted from the top of higher pressure column 52 as a stream 56, is condensed within a condenser-reboiler 57 located in the base of lower pressure column 54 against boiling an oxygen-rich liquid column bottoms 58. The boiling of oxygen-rich liquid column bottoms 58 initiates the formation of an ascending vapor phase within lower pressure column 54. The condensation produces a liquid nitrogen containing stream 60 that is divided into streams 62 and 64 that reflux the higher pressure column 52 and the lower pressure column 54, respectively to initiate the formation of descending liquid phases in such columns.

Exhaust stream 34 is introduced into the higher pressure column 52 along with the liquid stream 46 for rectification by contacting an ascending vapor phase of such mixture within a plurality of mass transfer contacting elements, illustrated as contacting elements 66 and 68, with a descending liquid phase that is initiated by reflux stream 62. This produces a crude liquid oxygen column bottoms 70, also known as kettle liquid and the nitrogen-rich column overhead. A stream 72 of the crude liquid oxygen column bottoms 70 is expanded in an expansion valve 74 to the pressure at or near that of the lower pressure column 54 and is introduced into the lower pressure column for further rectification. Second liquid stream 48 is passed through an expansion valve 76, expanded to the pressure at or near that of the lower pressure column 54 and then introduced into lower pressure column 54.

Lower pressure column 54 is also provided with a plurality of mass transfer contacting elements, illustrated as contacting elements 78, 80, 82 and 84 that can be trays or structured packing or random packing or other known elements in the art of cryogenic air separation. As stated previously, the separation produces an oxygen-rich liquid 58 and a nitrogen-rich vapor column overhead that is extracted as a nitrogen product stream 86. Additionally, a waste stream 88 is also extracted to control the purity of nitrogen product stream 86. Both nitrogen product stream 86 and waste stream 88 are passed through a subcooling unit 90 designed to subcool the reflux stream 64. A portion of the reflux stream 64 may optionally be taken as a liquid product stream 92 and the remaining portion (shown as stream 93) may be introduced into lower pressure column 54 after passing through expansion valve 94.

After passage through subcooling unit 90, nitrogen product stream 86 and waste stream 88 are fully warmed within main heat exchanger 3 to produce a warmed nitrogen product stream 95 and a warmed waste stream 96. Although not shown, the warmed waste stream 96 may be used to regenerate the adsorbents within prepurification unit 16. In addition, an oxygen-rich liquid stream 98 is extracted from the oxygen-rich liquid column bottoms 58 near the bottom of the lower pressure column 54. Oxygen-rich liquid stream 98 can be pumped by a pump 99 to form a pumped product stream as illustrated by pumped liquid oxygen stream 100. Part of the pumped liquid oxygen stream 100 can optionally be taken directly as a liquid oxygen product stream 102, with the remainder, namely stream 104, being directed to the main heat exchanger 3 where it is warmed and vaporized to produce a pressurized oxygen product stream 106. Although only one such stream 104 is shown, there could be a plurality of such streams that are fed into the main heat exchanger 3. Pumped liquid oxygen stream 100 can be pressurized to above or below the critical pressure so that oxygen product stream 106 when discharged from the main heat exchanger 3 will be a supercritical fluid. Alternatively, the pressurization of pumped liquid oxygen stream 100 could be lower to produce an oxygen product stream 106 in a vapor form.

The main heat exchanger 3 is preferably a brazed aluminum plate-fin type heat exchanger. Such heat exchangers are advantageous due to their compact design, high heat transfer rates and their ability to process multiple streams. They are manufactured as fully brazed and welded pressure vessels. The brazing operation involves stacking corrugated fins, parting sheets and end bars to form a core matrix. The matrix is placed in a vacuum brazing oven where it is heated and held at brazing temperature in a clean vacuum environment. For small plants, a heat exchanger comprising a single core may be sufficient. For higher flows, a heat exchanger may be constructed from several cores which must be connected in parallel or series.

Supplemental Refrigeration Circuit

As indicated above, air separation plant 1 is capable of producing liquid products, namely, nitrogen-rich liquid stream 92 and liquid oxygen product stream 102. In order to increase the production of such liquid products, additional refrigeration is supplied by a supplemental refrigeration circuit 7. In the present system, the supplemental refrigeration circuit 7 is preferably added to the cryogenic air separation plant 1 after initial plant construction. Thus, the design of the supplemental refrigeration circuit 7 is tailored for such late add-on or retrofit application and the tie-in points to the cryogenic air separation plant 1 are minimized In the illustrated embodiments, there are three key tie-in points between the cryogenic air separation plant 1 and supplemental refrigeration circuit 7. The first tie-in point 100 preferably occurs downstream of the main air compression train 2 where a portion of the compressed and purified feed air stream is diverted as third stream 110. This diverted third stream 110 provides a base volume of refrigerant for the supplemental refrigeration circuit 7. The second tie-in point 200 is within the booster air compression circuit 6 or turbine based refrigeration circuit 4 and is configured to divert a portion of the further compressed stream 30 upstream of the main heat exchanger as stream 156 to an auxiliary heat exchanger 180 in the supplemental refrigeration circuit 7 where it is cooled by the refrigerant stream 152. The cooled stream 158 is then returned to the turbine based refrigeration circuit 4 at the third tie-in point 300 downstream of the main heat exchanger 3. Advantageously, the selected tie-in points avoid changes to the main heat exchanger 3 and distillation column systems.

The closed loop supplemental refrigeration circuit 7 uses a compressible working fluid or refrigerant such as air which is compressed in a multi-stage compression section 115. Preferably, the working fluid or refrigerant stream 114 within the closed loop supplemental refrigeration circuit 7 is compressed in a first compressor 116 and then fed to a second booster compressor 118 coupled to a turbo-expander 124. The compressed working fluid or refrigerant stream 122 may then be cooled using an aftercooler 120 to remove the heat of compression prior to expansion in turbo-expander 124. Preferably, the aftercooler 120 cools the compressed working fluid stream 122 to ambient or a chilled temperature by means of chilled water or other refrigeration source associated with the air separation plant. Such aftercooling generally improves cycle efficiency and prevents damage to the turbo-expander 124 due to high temperatures.

The turbo-expander 124 is configured to expand the compressed working fluid stream 122 to generate a cooled working fluid stream 152. The cooled working fluid stream 152 is then warmed in the auxiliary heat exchanger 180 so as to impart a portion of the refrigeration required by the air separation plant 1 required to produce the nitrogen and oxygen liquid product streams 92 and 102. The warmed working fluid stream 154 is recirculated back to the compressor section 115 after having passed through the auxiliary heat exchanger 180. As indicated above, the turbo-expander 124 is preferably linked with booster compressor 118, either directly or by appropriate gearing.

Although not shown, the turbo-expander may to be connected or operatively coupled to a generator. Such generator loaded turbo-expander arrangement allows the speed of the turbo-expander to be maintained constant even at very high or low loads. This arrangement is desirable in some applications because the speed of the turbo-expander would remain generally constant at the ideal efficiency across the entire operating envelope and the control methods of the turbo-expander, as discussed in more detail below, would be further simplified. In such arrangements, the generator load may be connected to the turbo-expander by means of a high speed generator. Alternatively, the generator load may be connected to the turbo-expander by means of a high speed coupling connected to an internal or external gearbox and with a low speed coupling from the gearbox to the generator.

Operational Control of the Supplemental Refrigeration Circuit

Once installed, the operation and control of the supplemental refrigeration circuit should be controlled to avoid cycling of the compressors and turbo-expanders between operating mode or 'on' mode where additional liquid product is needed and shut-down or 'off' mode when the supplemental refrigeration is not required. Such cycling adversely impacts the overall efficiency and reliability of the supplemental refrigeration cycle. Rather, the supplemental refrigeration circuit should be capable of turn down so as to provide less supplemental refrigeration, but without completely shutting down when less liquid product is needed.

By modifying the operation and control of the illustrated supplemental refrigeration circuit, the overall performance of the supplemental refrigeration circuit and system can be improved compared to conventional supplemental refrigeration circuit that are cycled. In particular, it has been found that compressors and turbo-expanders typically used in such supplemental refrigeration systems can maintain efficiencies and operating speeds that are very stable over very large pressure ranges, provided the pressure ratios and volumetric flow rates are held generally constant. If one were able to maintain the pressure ratios and volumetric flow rates through the compressors and turbo-expanders of the supplemental refrigeration system at substantially constant levels, the power generated becomes proportional to the absolute pressure and hence the mass flow at the inlet of the system.

As discussed above, the source of the working fluid or refrigerant stream 114 is preferably a portion of the compressed and purified feed air stream 18, diverted as charge stream 110 to the supplemental refrigeration circuit 7 upstream of the compressor 116. Working fluid or refrigerant may be added via one or more inlet valves 112 and 142 operatively disposed upstream of the compressor 116 of the supplemental refrigeration circuit 7 that are open and closed, as required, to maintain a substantially constant volumetric flow rate of the working fluid through the compressors 116, 118 and turbo-expander 124 and a substantially constant pressure ratio across the compressor section 115. Inlet valves 112 and 142 are controllably operated to set the inlet pressure of the compressor 116 and hence outlet pressure of the turbo-expander 124. Inlet valve 112 is preferably larger of the two inlet valves and is used to charge or pressurize the supplemental refrigeration circuit or opened when rapid change in the inlet pressure is needed whereas inlet valve 142 provides continuing adjustment to the pressure in the supplemental refrigeration circuit 7. In this manner, increasing the inlet pressure in the supplemental refrigeration circuit 7 can increase the power provided by equipment and hence the refrigeration imparted to the auxiliary heat exchanger 180 and back to the cryogenic air separation plant 1 thereby allowing for a higher liquid make rate. Conversely, decreasing the pressure in the supplemental refrigeration circuit 7 will decrease the power and lower the refrigeration imparted to the auxiliary heat exchanger 180 (and subsequently cryogenic air separation plant) thereby reducing the liquid make rate.

In addition, working fluid to may be added to the supplemental refrigeration circuit 7 by means of a low pressure make-up supply of refrigerant provided via valve 143 upstream of the compressor 116 to maintain a minimum pressure in the supplemental refrigeration circuit 7. Generally valve 143 will open if a minimum pressure in the supplemental refrigeration circuit 7 is not maintained, as may occur during typical shutdown operation.

The supplemental refrigeration circuit 7 also includes a vent system 140 comprising a valve 144 and vent 145 disposed upstream of the turbo-expander 124. The vent system 140 is configured to removing a portion of the working fluid or refrigerant in the supplemental refrigeration circuit 7 when the pressure is above the desired or targeted pressure so as to maintain the substantially constant volumetric flow rate and substantially constant pressure ratios. An auxiliary vent arrangement including valves 146, 147 and vent 148 are optionally disposed downstream of the turbo-expander 124 and upstream of the auxiliary heat exchanger 180 that typically opens during startup.

Using a supplemental refrigeration circuit controller (not shown) to add or remove working fluid, the degree to which supplemental refrigeration is supplied to auxiliary heat exchanger 180 and cryogenic air separation plant can be generally controlled. The controller is preferably a master PLC type control unit operatively connected to local PID controllers (not shown) that control the vent system valve 144, and inlet valves 112, 142 to adjust or control the removal or addition of working fluid in the supplemental refrigeration circuit 7 while maintaining a substantially constant volumetric flow rate of the working fluid through compressor and turbo-expander sections of the supplemental refrigeration circuit and a substantially constant pressure ratio across the compressor section. Alternatively, the supplemental refrigeration circuit controller can be a manual or operator based controller. Adjusting the setpoints for the vent system valve 144 and/or inlet valves 112, 142 changes the inlet pressure to the supplemental refrigeration circuit 7 and as indicated above, either: (i) increases the supplemental refrigeration and thereby increases liquid product make rate in the air separation plant 1; or (ii) decreases supplemental refrigeration and thereby decreases the liquid product make rate in the air separation plant 1.

In addition, the supplemental refrigeration circuit controller or other suitable control means may be configured to also control the adjustments to the inlet guidevanes 117 on compressor 116 and/or compressor 118 as well as the turbine nozzle arrangements 125 in the turbo-expander 124. Adjustments of the turbine nozzles 125 are controlled to maintain substantially constant volumetric flow rates over wide pressure variations. The turbine nozzles 125 are also adjusted to keep the pressure ratio over the turbo-expander 124 generally constant. Adjustment of the compressor inlet guidevanes 117 on one or both of the compressors 116, 118 helps maintain the substantially constant pressure ratio across the compressors, and more particularly, makes necessary adjustments to correct for effects such as compressibility of the working fluid, changes in inlet temperature and mismatches with the turbine nozzles 125.

The preferred method of operating an air separation plant with the disclosed supplemental refrigeration circuit comprises the steps of : (i) conducting a cryogenic rectification process in an air separation plant to produce liquid nitrogen and/or liquid oxygen; (ii) diverting a portion of the compressed and purified feed air stream to the supplemental refrigeration circuit as the refrigerant or working fluid; (iii) producing a portion of the refrigeration required by the air separation plant by compressing and subsequently expanding (and thereby cooling) the refrigerant or working fluid in the supplemental refrigeration circuit, as described above; (iv) warming the expanded and cooled refrigerant or working fluid in the auxiliary heat exchanger via indirect heat exchange with a further compressed air stream diverted from the boosted air compression circuit or turbine based refrigeration circuit of the cryogenic air separation plant; (v) returning the cooled further compressed air stream from the auxiliary heat exchanger to the turbine based refrigeration circuit of the cryogenic air separation plant; (vi) recirculating the warmed working fluid back through the supplemental refrigeration circuit to the compression section of the supplemental refrigeration circuit; and (vii) removing or adding working fluid to the supplemental refrigeration circuit to adjust the inlet pressure in the supplemental refrigeration circuit while maintaining substantially constant volumetric flow rate of the working fluid and substantially constant pressure ratios in the supplemental refrigeration circuit.

Adjusting the inlet guidevanes in the compressors in the supplemental refrigeration circuit and/or the turbine nozzles in the turbo-expander in the supplemental refrigeration circuit optimizes the pressure ratios and constant volume flows, respectively. Adding the additional mass flow of the refrigerant or working fluid ultimately allows for the increase in the supplemental refrigeration and thereby allows for increasing the liquid product make rate in the air separation plant. Conversely, removing the refrigerant or working fluid generally decreases the supplemental refrigeration and thereby decreases the liquid product make rate in the cryogenic air separation plant.

Although the present invention has been discussed with reference to a preferred embodiment, as would occur to those skilled in the art that numerous changes and omissions can be made without departing from the spirit and scope of the present inventions as set forth in the appended claims.

What is claimed is:

1. A method of separating air comprising the steps of:

conducting a cryogenic rectification process in an air separation plant in a first mode to produce gaseous products and at least one liquid product stream, the air separation plant comprising a main air compression train configured to compress and purify a feed air stream; a main heat exchanger configured to cool a first portion of the compressed and purified feed air stream to a temperature suitable for the rectification; a turbine based refrigeration circuit configured to further compress, partially cool and expand a second portion of the compressed and purified feed air stream; and a distillation column system configured to rectify the first and second portions of the compressed and purified feed air stream;

operatively coupling a supplemental refrigeration circuit to the air separation plant at a plurality of tie-in points;

wherein a first tie-in point is disposed downstream of the main air compression train and is configured to divert a third portion of the compressed and purified feed air stream; the third portion of the compressed and purified feed air stream being the working fluid for the supplemental refrigeration circuit;

wherein a second tie-in point is disposed downstream of a compressor in the turbine based refrigeration circuit and upstream of the main heat exchanger, the second tie-in point is configured to divert all or a portion of the second portion of the compressed and purified feed air stream to an auxiliary heat exchanger;

wherein a third tie-in point is disposed downstream of the main heat exchanger and upstream of a turbine in the turbine based refrigeration circuit, the third tie-in point is configured to combine the diverted portion of the second portion of the compressed and purified feed air stream from the auxiliary heat exchanger to the turbine based refrigeration circuit upstream of the turbine;

conducting the cryogenic rectification process in the air separation plant in a second mode to produce the gaseous products and the at least one liquid product stream, wherein the liquid product make of the air separation plant operating in the second mode is greater than the liquid product make of the air separation plant operating in the first mode;

wherein the cryogenic rectification process conducted in the second mode further comprises the steps of:

diverting the third portion of the compressed and purified feed air stream as the working fluid to a supplemental refrigeration circuit;

compressing the working fluid in a compressor section within the supplemental refrigeration circuit;

expanding the working fluid in a turbo-expander disposed within the supplemental refrigeration circuit to produce a cooled working fluid;

directing the cooled working fluid to the auxiliary heat exchanger and warming the cooled working fluid in the auxiliary heat exchanger via indirect heat exchange with the diverted portion of the second portion of the compressed and purified feed air stream;

recirculating the warmed working fluid to the compressor section within the supplemental refrigeration circuit after having passed through the auxiliary heat exchanger; and returning the cooled, the diverted portion of the second portion of the compressed and purified feed air stream exiting the auxiliary heat exchanger to the air separation plant at the third tie-in point to impart a portion of the refrigeration required by the air separation plant to increase the liquid product make.

2. The method of claim 1 further comprising the steps of:

removing a portion of the working fluid in the supplemental refrigeration circuit upstream of the turbo-expander thereby decreasing the refrigeration imparted by the supplemental refrigeration circuit and the production of the at least one liquid product stream or adding working fluid to the supplemental refrigeration circuit upstream of the compressor section thereby increasing the refrigeration imparted by the supplemental refrigeration circuit and the production of the at least one liquid product stream;

wherein the removal of the working fluid from the supplemental refrigeration circuit or the adding of the working fluid to the supplemental refrigeration circuit being conducted such that the inlet pressure within the supplemental refrigeration circuit is adjusted commensurate with the desired production of the at least one liquid product stream while the working fluid circulates at a substantially constant volumetric flow rate and the pressure ratio across the compressor section is maintained substantially constant.

3. The method of claim 2 wherein the step of removing a portion of the working fluid in the supplemental refrigeration circuit upstream of the turbo-expander further comprises venting a portion of the working fluid to maintain the working fluid in the supplemental refrigeration circuit at or below a prescribed maximum pressure.

4. The method of claim 1 further comprising the step of venting a portion of the working fluid downstream of the turbo-expander of the supplemental refrigeration circuit to maintain the working fluid in the supplemental refrigeration circuit at or below a prescribed maximum pressure and to maintain the cooled working fluid directed to the main heat exchanger at or below a prescribed maximum temperature.

5. The method of claim 2 wherein the step of adding working fluid to the supplemental refrigeration circuit upstream of the compressor section further comprises adding a flow of make-up working fluid to the supplemental refrigeration circuit to maintain the inlet pressure to the compressor section at or above a prescribed minimum pressure.

6. The method of claim 2 wherein the working fluid in the supplemental refrigeration circuit is supplied from the compressed and purified air and the step of adding working fluid to the supplemental refrigeration circuit upstream of the compressor section further comprises modulating the supply of the working fluid charge to the supplemental refrigeration circuit to adjust the inlet pressure of the compressor section.

7. The method of claim 1 further comprising the step of adjusting compressor guidevanes in the compressor section to maintain the substantially constant pressure ratio across the compressor section.

8. The method of claim 7 further comprising the step of adjusting turbine nozzles in the turbo-expander to maintain substantially constant volumetric flow rate in the supplemental refrigeration circuit.

9. The method of claim 8 further comprising the step of operatively controlling the amount of supplemental refrigeration required by the air separation plant to produce the at least one liquid product stream by controlling the removal of working fluid, the addition of working fluid, the adjusting of compressor guidevanes, and the adjusting of turbine nozzles via a controller to maintain a substantially constant pressure ratio across the compressor section and substantially constant volumetric flow rate in the supplemental refrigeration circuit.

10. An air separation plant comprising:

a main air compression train configured to compress and purify a feed air stream;

a main heat exchanger configured to cool a first portion of the compressed and purified feed air stream to a temperature suitable for the rectification;

a turbine based refrigeration circuit configured to further compress, partially cool and expand a second portion of the compressed and purified feed air stream;

a distillation column system configured to rectify the first and second portions of the compressed and purified feed air stream a supplemental refrigeration circuit coupled to the air separation plant at a plurality of tie-in points, the supplemental refrigeration circuit comprising: an intake conduit configured to receive a working fluid; a compressor section fluidically coupled to the intake conduit and configured to compress the working fluid; a turbo-expander operatively coupled to the compressor section and configured to expand the compressed working fluid to generate a cooled working fluid; an auxiliary heat exchanger configured to receive the cooled working fluid from the turbo-expander section and warm the cooled working fluid via indirect heat exchange; and a recirculating conduit configured to return the warmed working fluid from the auxiliary heat exchanger to the compressor section;

wherein a first tie-in point is disposed downstream of the main air compression train and is configured to divert a third portion of the compressed and purified feed air stream to the supplemental refrigeration circuit; the third portion of the compressed and purified feed air stream being the working fluid for the supplemental refrigeration circuit;

wherein a second tie-in point is disposed downstream of a compressor in the turbine based refrigeration circuit and upstream of the main heat exchanger, the second tie-in point is configured to divert all or a portion of the second portion of the compressed and purified feed air stream to the auxiliary heat exchanger to warm the cooled working fluid;

wherein a third tie-in point is disposed downstream of the main heat exchanger and upstream of a turbine in the turbine based refrigeration circuit, the third tie-in point is configured to combine the diverted portion of the second portion of the compressed and purified feed air stream from the auxiliary heat exchanger to the turbine based refrigeration circuit upstream of the turbine; and wherein the air separation plant is configured to operate in a high liquid make operating mode with flows traversing through the supplemental refrigeration circuit to produce gaseous products and at least one liquid product stream.

11. The air separation plant of claim 10 further comprising:

a diversion conduit coupling the second tie-in point to the auxiliary heat exchanger and configured to divert all or a portion of the second portion of the compressed and purified feed air stream to be cooled in the auxiliary heat exchanger by the cooled working fluid; and a return conduit coupling the auxiliary heat exchanger to the third tie-in point and configured to return the cooled diverted portion to the turbine based refrigeration circuit.

12. The air separation plant of claim 11 further comprising:

one or more control valves disposed in the intake conduit, the diversion conduit, the recirculating conduit, the compressor section, or the turbo-expander; and a controller operatively coupled to the one or more control valves and configured to regulate the flows through the intake conduit, the diversion conduit, the recirculating conduit, the compressor section, or the turbo-expander.

13. The air separation plant of claim 10 further comprising an aftercooler disposed within the compressor section or downstream of the compressor section and configured to cool the compressed working fluid.

14. The air separation plant of claim 10 further comprising a warm venting section configured to vent a portion of the warmed working fluid from the recirculating conduit.

15. The air separation plant of claim 14 further comprising a make-up source of working fluid coupled to the recirculating conduit or to the intake conduit and configured to supply supplemental working fluid to the supplemental refrigeration circuit upstream of the compressor section.

16. The air separation plant claim of 15 further comprising:

one or more control valves disposed in the warm venting section or in operative association with the make-up source; and a controller operatively coupled to the one or more control valves and configured to regulate the flows through the warm venting section or from the make-up source.

* * * * *